US008525745B2

(12) United States Patent
Lin et al.

(10) Patent No.: US 8,525,745 B2
(45) Date of Patent: Sep. 3, 2013

(54) FAST, DIGITAL FREQUENCY TUNING, WINGLET DIPOLE ANTENNA SYSTEM

(75) Inventors: Zhen Biao Lin, West Hills, CA (US); Jack J. Q. Lin, Northridge, CA (US); Seymour Robin, Woodland Hills, CA (US)

(73) Assignee: Sensor Systems, Inc., Chatsworth, CA (US)

( * ) Notice: Subject to any disclaimer, the term of this patent is extended or adjusted under 35 U.S.C. 154(b) by 444 days.

(21) Appl. No.: 12/911,529

(22) Filed: Oct. 25, 2010

(65) Prior Publication Data

US 2012/0098714 A1 Apr. 26, 2012

(51) Int. Cl.
*H01Q 1/28* (2006.01)
*H01Q 9/28* (2006.01)

(52) U.S. Cl.
USPC ..... 343/705; 343/795; 343/725; 343/802

(58) Field of Classification Search
USPC ..... 343/705, 708, 795, 725, 729, 802
See application file for complete search history.

(56) References Cited

U.S. PATENT DOCUMENTS

| | | | | |
|---|---|---|---|---|
| 3,858,220 | A | 12/1974 | Arnow | 343/802 |
| 4,117,492 | A | 9/1978 | Arnold | 343/747 |
| 4,370,660 | A | 1/1983 | Fahmy | 343/795 |
| 5,184,141 | A * | 2/1993 | Connolly et al. | 343/705 |
| 5,572,227 | A | 11/1996 | Pal et al. | 343/727 |
| 5,894,288 | A | 4/1999 | Lee et al. | 343/770 |
| 6,771,226 | B1 | 8/2004 | Dujmovic | 343/797 |
| 6,842,157 | B2 | 1/2005 | Phelan et al. | 343/893 |
| 6,954,182 | B2 | 10/2005 | Knapp | 343/705 |
| 6,961,028 | B2 | 11/2005 | Joy et al. | 343/895 |
| 6,970,141 | B2 | 11/2005 | Copeland et al. | 343/866 |
| 7,068,234 | B2 | 6/2006 | Sievenpiper | 343/745 |
| 7,071,888 | B2 | 7/2006 | Sievenpiper | 343/745 |
| 7,158,089 | B2 | 1/2007 | Mohammadian et al. | 343/795 |
| 7,164,387 | B2 | 1/2007 | Sievenpiper | 343/702 |
| 7,245,269 | B2 | 7/2007 | Sievenpiper | 343/909 |
| 7,298,228 | B2 | 11/2007 | Sievenpiper | 333/101 |
| 7,307,589 | B1 | 12/2007 | Gregoire et al. | 343/700 |
| 7,408,517 | B1 | 8/2008 | Poilasne et al. | 343/742 |
| 7,456,803 | B1 | 11/2008 | Sievenpiper | 343/909 |
| 2007/0046557 | A1 * | 3/2007 | Chen et al. | 343/795 |

(Continued)

OTHER PUBLICATIONS

Misra, V.C., Recent Trends in Antenas for Electronic Warfare Applications, DRDO Science Spectrum, Mar. 2009, pp. 114-119.

(Continued)

*Primary Examiner* — Hoanganh Le
(74) *Attorney, Agent, or Firm* — Koppel, Patrick, Heybl & Philpott

(57) ABSTRACT

Antenna system embodiments are illustrated that include a planar, top-loaded dipole antenna and a planar elliptical dipole antenna arranged substantially coplanar and within the top-loaded dipole antenna. These antenna structures facilitate their combination with tuning coil chains, baluns and impedance matching circuits to operate over multiple frequency bands. System embodiments exhibit high gain and selectivity and may be digitally tuned over wide frequency bands (e.g., 30-600 MHz). The embodiments may be digitally tuned to support operational modes such as frequency hopping to thereby realize a secure communication system. Because these embodiments are configured to operate in the absence of a ground plane, they are especially suited for mounting on various portions of an aircraft's structure. For example, they may be configured as winglets and situated far out on wingtips to thus free the remainder of an aircraft's structure for other operational systems.

25 Claims, 6 Drawing Sheets

(56) References Cited

U.S. PATENT DOCUMENTS

| | | | | |
|---|---|---|---|---|
| 2007/0080885 | A1* | 4/2007 | Ozkar et al. | 343/806 |
| 2008/0210822 | A1 | 9/2008 | Hanusa et al. | |
| 2008/0246679 | A1 | 10/2008 | Martek et al. | |
| 2009/0189823 | A1* | 7/2009 | Adamski | 343/814 |

OTHER PUBLICATIONS

Zhou, D., et al., "Design of Multiband Balanced Folded Dipole Antenna—for Mobile Handsets", PIERS Online, vol. 4, No. 8, pp. 821-824.

* cited by examiner

FAST, DIGITAL FREQUENCY TUNING, WINGLET DIPOLE ANTENNA SYSTEM

BACKGROUND OF THE INVENTION

1. Field of the Invention

The present invention relates generally to aircraft antennas.

2. Description of the Related Art

To enhance their operational capabilities, it is often desirable for modern aircraft to carry a variety of antenna systems that operate over wide frequency bands. Most of these systems require the presence of a ground plane so that they must generally be carried on an aircraft's fuselage. This restriction has placed serious limitations on aircraft performance.

BRIEF SUMMARY OF THE INVENTION

Compact, high-gain, fast-tuning, self-contained, dipole antenna systems are provided that are especially useful for operation over multiple frequency bands and for mounting in a wide variety of locations on aircraft because they are configured to operate in the absence of a ground plane. The drawings and the following description provide an enabling disclosure and the appended claims particularly point out and distinctly claim disclosed subject matter and equivalents thereof.

DETAILED DESCRIPTION OF THE INVENTION

FIGS. 1-6B illustrate antenna system embodiments and the performance of these embodiments. The antenna system embodiments are compact and are especially suited for operation in the absence of a ground plane so that they may be mounted on various portions of an aircraft's structure. For example, they may be configured as winglets and situated far out on wingtips to thus free the remainder of an aircraft's structure for other operational systems. In addition, the antenna system embodiments can be rapidly switched between channels within multiple frequency bands and provide superior performance of antenna parameters, e.g., return loss and gain.

Figure 1:
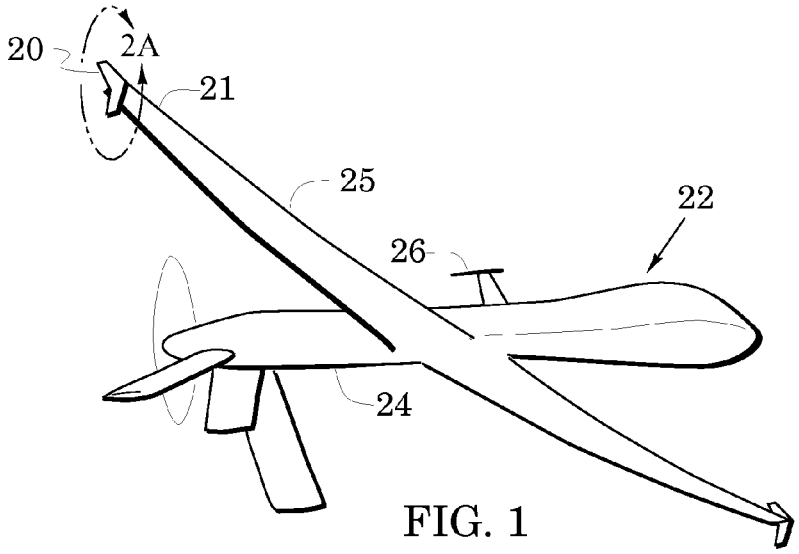
FIG. 1 illustrates an exemplary airplane and also illustrates winglet antenna embodiments that are carried on the airplane's wingtips.

In particular, FIG. 1 illustrates winglet antenna embodiments 20 that are mounted to the wingtips 21 of an airplane 22. Because the antennas 20 are carried far out on the wingtips, the fuselage 24 of the airplane is completely available for mounting of other auxiliary aircraft structures. For example, a monopole antenna 26 is carried on the upper portion of the metallic fuselage which then forms a ground plane for this monopole antenna. Radiation reflection off of this ground plane causes the monopole antenna to respond substantially as if it were a dipole antenna. Because only the monopole portion extends away from the fuselage, the height of fuselage-mounted monopole antennas is considerably reduced and this reduction is highly desirable in the wind stream environment provided by airplanes in flight.

However, a considerable portion of the aircraft's wings 25 may be formed of electromagnetically-transparent materials (e.g., fiberglass) and the winglet antennas must therefore operate in the absence of a ground plane. To adapt to this absence, the antennas 20 have been configured as dipole antennas which effectively operate without the presence of a ground plane. They may thus be carried on the airplane's wingtips 21 and this important feature advantageously frees up the fuselage for the mounting of other antennas and other systems.

Figure 2A:
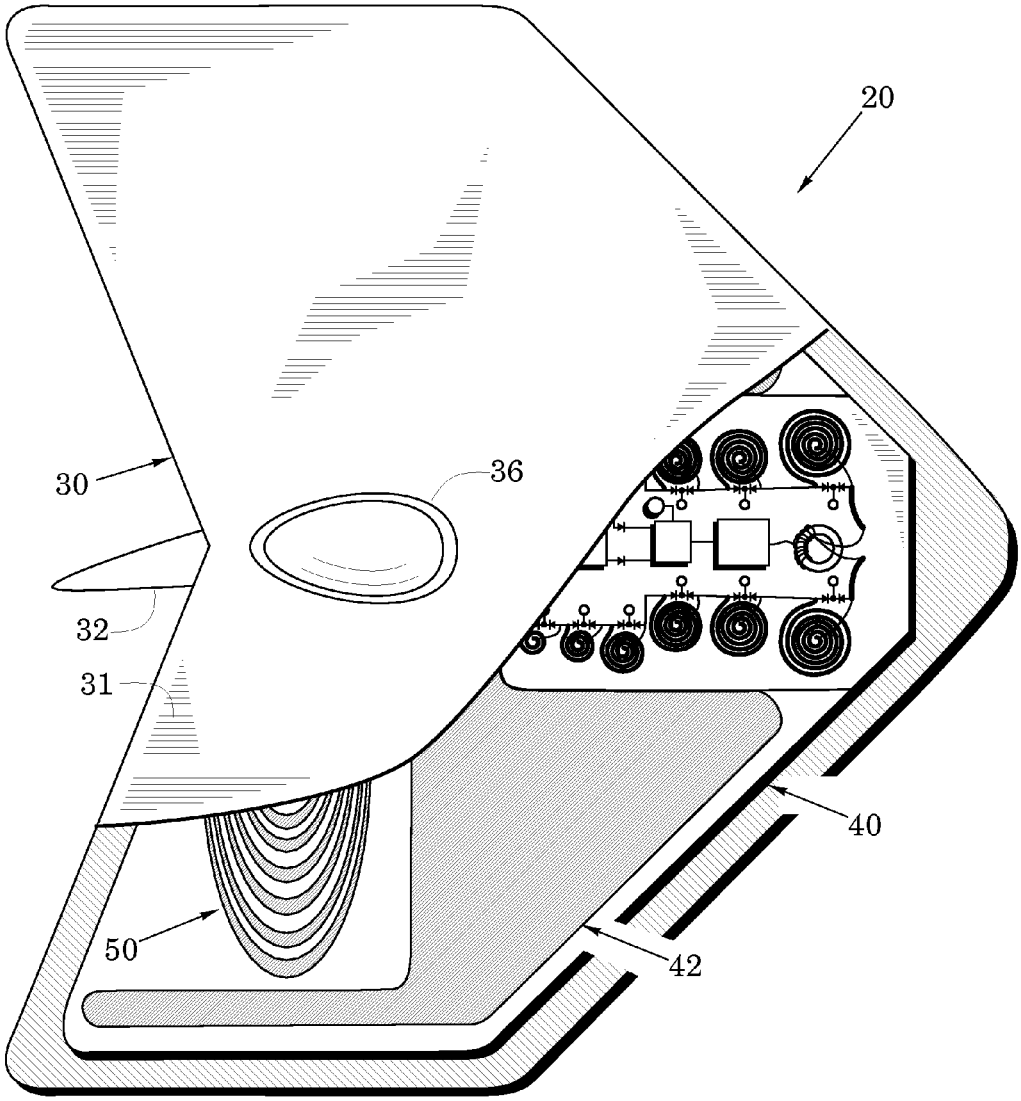
FIG. 2A is an enlarged side view of the winglet antenna within the ellipse 2A in FIG. 1.
Figure 2B:
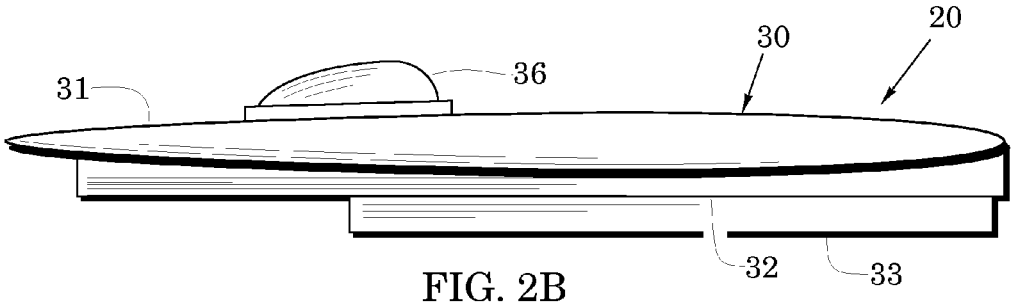
FIGS. 2B and 2C are respectively bottom and rear views of the winglet antenna of FIG. 2A.
Figure 2C:
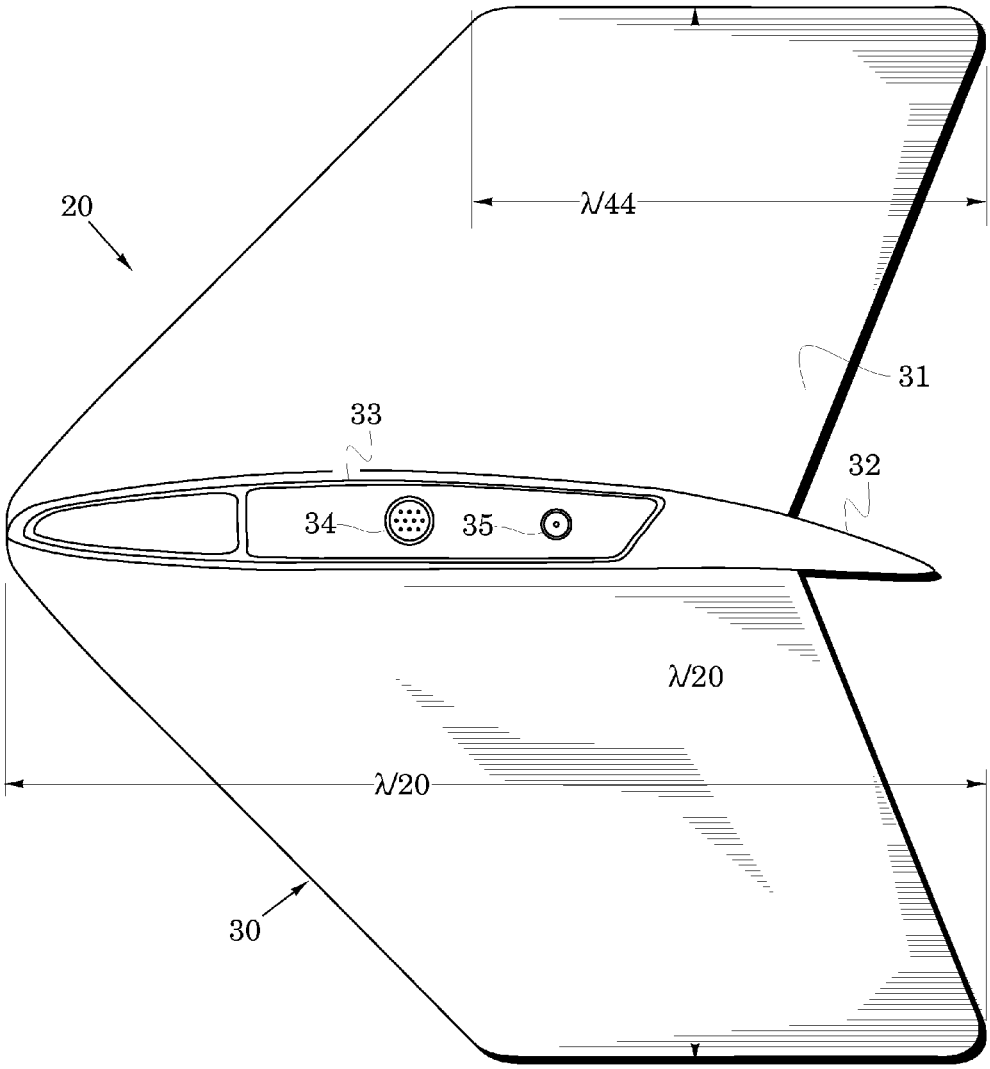

FIG. 2A is an enlarged view of the winglet antenna system 20 of FIG. 1. FIGS. 2B and 2C are respectively bottom and rear views of the antenna system of FIG. 2A. FIG. 2A particularly shows an antenna system 40 mounted within the radome portion 31 of a housing 30. The housing forms a radome portion 31, a stub portion 32 that extends away from radome, and a rim 33 that extends away from the stub portion. The radome and the stub are aerodynamically-shaped to generally conform with the outer shapes of the airplane (22 in FIG. 1). In particular, the radome is arranged to extend above and below the stub which is shaped to match the shape of the wingtip (21 in FIG. 1).

When the stub is mounted to the wingtip, the rim 33 slips inside the wingtip. The rim surrounds connection structures (e.g., a multi-pin logic signal connector 34 and a TNC RF connector 35) that functionally connect the antenna system 20 to electronic systems within the airplane (20 in FIG. 1). As shown, a navigation light 36 may be carried on the outer surface of the radome 31.

The radome 31 is cut away in FIG. 2A to reveal an antenna system embodiment 40 that is protectively carried within the radome 31 which is preferably formed with electromagnetically-transparent materials so that it does not interfere with the antenna system's operation. As shown in FIG. 2A, the system 40 includes a planar, top-loaded antenna 42 and a planar elliptical antenna 50. Interfacing with the antennas are electronics. The antennas and the electronics are shown in detail in FIGS. 3A and 4.

Figure 3B:
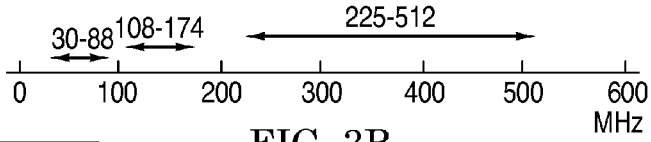
FIG. 3B is a frequency chart that shows exemplary operational frequency bands of the antenna system of FIG. 3A.
Figure 3A:
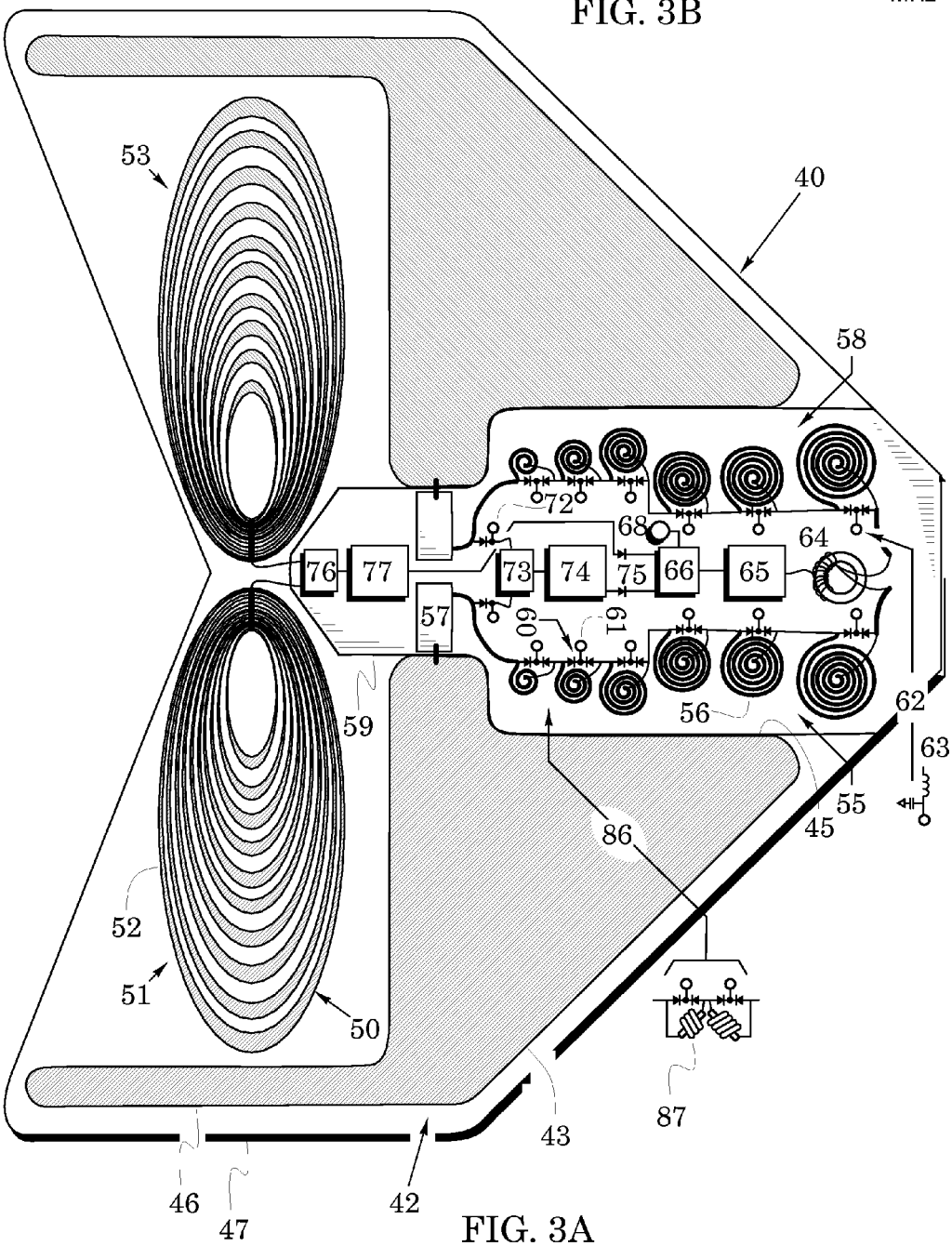
FIG. 3A is a view of an antenna system embodiment within a radome of the winglet antenna of FIG. 2A.
Figure 4:
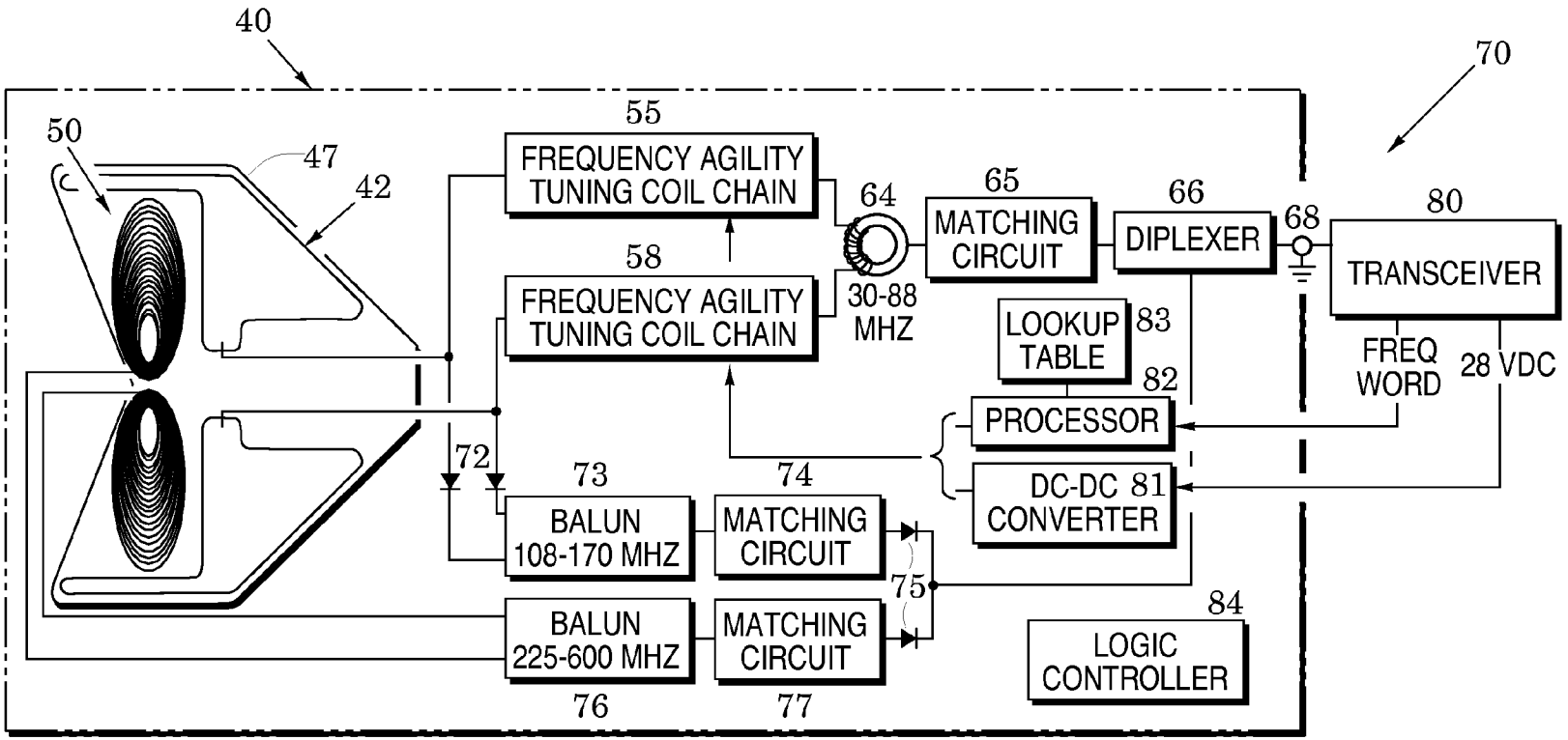
FIG. 4 is a block diagram of the antenna system of FIG. 3A.

A somewhat-enlarged view of the antenna system 40 of FIG. 2A is shown in FIG. 3A. Because the block diagram of FIG. 4 includes many of the elements of FIG. 3A, the following description applies to both of these figures. In the embodiment shown, the antenna system 40 includes a planar, top-loaded dipole antenna 42 and a planar elliptical dipole antenna 50 that is arranged substantially coplanar with the antenna 42. The antenna 42 comprises first and second opposed portions that are each formed with a top-loaded blade 43. A leading edge 44 of the blade is preferably swept back as it rises from a base edge 45 to conform to the aerodynamically-shaped radome (31 in FIG. 2A). In the embodiments of FIGS. 3A and 4, the blade 43 has a substantially triangular shape and an elongate top load 46 protrudes rearward from the outer edge of the blade 43. The top-loaded blade is formed by a metallic coating that is carried on an electromagnetically-transparent carrier 47 (formed, for example, by fiberglass).

FIGS. 3A and 4 show that an elliptical dipole antenna 50 is positioned between the top loads 46 of the top-loaded dipole antenna 42. This antenna is also formed by a metallic coating on the carrier 47 so that it is substantially coplanar with the antenna 42. The antenna 50 comprises a first set 51 of nested elliptical rings 52 and a second set 53 of nested elliptical rings that are arranged in a dipole relationship with the first set. As shown in this embodiment, centers of the elliptical rings in each of the first and second sets are progressively spaced towards the other of the first and second sets. Accordingly, the inner ends of the elliptical rings 52 can be easily joined together to facilitate electrical connection to the antenna. Because the elliptical dipole antenna 50 can be sized to lie between the top loads 46, the size of the antenna system 20 is small enough to facilitate its use on aircraft wingtips.

FIG. 3A also shows a first string 55 of inductors 56 that is coupled to the inner edge of one of the blades 43 (via a circuit board pad 57) and a second string 58 of similar inductors that is coupled to the inner edge of the other of the blades (the strings are referred to in FIG. 4 as frequency agility tuning chains). These inductors are realized with conductive plating that is preferably carried on a printed-circuit board 59 that is mounted on the carrier 47.

The top-loaded dipole antenna 42 is configured to operate over a first frequency band. Although the antenna system 40 of FIG. 3A can be configured to conform to various first frequency bands, the frequency chart of FIG. 3B illustrates an exemplary first frequency band of 30-88 MHz. In this frequency band, the blade 43 has been found to present a small resistance in series with a capacitive reactance which decreases from a rather large initial value at the lower edge of the frequency band to a smaller final value at the upper edge of the frequency band.

As shown in FIG. 3A, the spiral inductors 56 have different numbers of windings so that their inductance progressively varies from a low value to a high value. In an exemplary binary progression, if the smallest inductor has an inductance L, then the second inductor has an inductance 2L, the third an inductance 4L and so on. Pairs 60 of opposed fast switching diodes (e.g., PIN diodes formed by positive and negative type regions separated by an intrinsic region) are arranged in parallel with each of the inductors. Signals applied to ports 61 of each diode pair can selectively reverse and forward bias those diodes so that the associated inductor is either included in the string of inductors or is excluded (in the latter case, the inductor is bypassed by a shorted path through the diodes). As indicated by an arrow 62, these signals are preferably applied to the ports 61 through the isolation of a low-pass filter such as the series inductor and shunt capacitor 63.

With the pairs 60 of switching diodes, inductors 57 of each of the strings 55 and 58 can be selected to form a combined inductance that will, when presented to the associated top-loaded blade 43, substantially cancel that blade's capacitance at the selected frequency within the first frequency band. Accordingly, only the small resistance introduced above remains and that is fed into the balun 64 (balun is an abbreviation of "balanced impedance to unbalanced") which is arranged to convert the balanced impedance of the frequency agility tuning chains 55 and 58 to an unbalanced single-ended impedance that is referenced to ground. The output of the balun 64 goes into an impedance matching circuit 65 to convert the remaining small resistance to approximate a 50 ohm resistance. A diplexer 66 is coupled to the impedance matching circuit 65 and the output of the diplexer is fed to an antenna output port 68.

To this point, the description has assumed the antenna system 40 is operating in the exemplary first frequency band of 30-88 MHz that is shown in FIG. 3B. It is noted that switching diodes 72 (and associated ports for application of switching signals) are arranged to couple the circuit pads 57 to a second balun 73. In the first frequency band these diodes would be biased off. When the antenna system is operated in the exemplary second frequency band of 108-174 MHz (shown in FIG. 3B), these diodes are biased on so that signals from the top-loaded dipole antenna 42 are guided to a second balun 73. The single-ended output of the second balun is coupled to a second impedance matching circuit 74 and the output of this circuit can be switched via an appropriate one of switching diodes 75 to the diplexer 66.

The second impedance matching circuit is configured to convert, for channels within the second frequency band, the impedance of the top-loaded dipole antenna 42 to substantially 50 ohms Output signals from the second impedance matching circuit 74 are then applied to the diplexer 66 through a respective one of a pair of switching diodes 75. It is noted that the capacitance of the top-loaded dipole antenna 42 is substantially lower in the second frequency band so that the impedance of the antenna can be substantially converted to 50 ohms in this band without the need for an intervening tuning coil chain such as the chains 55 and 58 that were used in association with the first frequency band. The impedance of these chains in the second frequency band is sufficiently high enough so that signals in this band are diverted through the switching diodes 75 when they are biased on.

FIGS. 3A and 4 show that a third balun 76 couples the elliptical dipole antenna 50 to a third impedance matching circuit 77. Signals in the exemplary third frequency band of 225-600 MHz (shown in FIG. 3B) are sent by the elliptical dipole antenna 50 through the third balun 76 and the third impedance matching circuit 77. Signals from the output of the third impedance matching circuit can then be switched via an appropriate one of switching diodes 75 to the diplexer 66. Exemplary performance of the elliptical dipole antenna and the third balun and third impedance matching circuit is shown in FIG. 5B.

Embodiments of the impedance matching circuits 65, 74 and 77 may be formed with inductors and capacitors that are arranged in ways well known in the impedance-matching art to convert input impedances, in each of the three frequency bands of FIG. 3B, to ones approximating 50 ohms for application of signals to the diplexer 66.

Although the planar inductors 56 of the strings 55 and 58 of FIG. 3A are uniquely suited for fabrication processes of the printed circuit board 59, other inductor forms may be used in other antenna system embodiments. For example, a replacement arrow 86 in FIG. 3A indicates that the planar inductors 56 can be replaced by inductors 87 that are formed with wire that has been formed into coils. The inductors 87 are carried on the printed circuit board 59 but rise above the board. As shown, the coils of neighboring inductors 87 are preferably arranged orthogonally to thereby reduce inductive coupling between them.

FIG. 4 illustrates an exemplary application of the antenna system 40 in which it interfaces with a transceiver 80 to form a radio 70. The transceiver also supplies 28 VDC to a DC-DC converter 81 and sends a frequency word to a processor 82 which is configured to then set up the antenna system 40 for processing of signals having the frequency denoted by the frequency word. After the processor receives the frequency word, it accesses a digital lookup table to determine the appropriate code to switch the pairs 60 of switching diodes, the switching diodes 72 and the switching diodes 75. A logic controller 84 is shown in FIG. 4 to facilitate digital control of the circuits described above. This control may support operational modes such as frequency hopping to thereby realize a secure communication system. The controller preferably interfaces with the multi-pin connector 35 of FIG. 2C.

For operation in the first frequency band (30-88 MHz) of FIG. 3B, the processor turns off the switching diodes 72 and 75 and switches on appropriate ones of the pairs 60 of diodes in FIG. 3A to thereby leave appropriate inductors of the sets 55 and 58 in the signal paths. For each operational channel the selected inductors of the strings 55 and 58 provide inductances that substantially match the capacitance of the top-loaded antenna 42 at that channel. The first balun 64 then converts the balanced configuration of the tuning coil chains to the unbalanced configuration (i.e., circuit above a ground plane) of the impedance matching circuit 65.

The processes of the tuning coil chains 55 and 58, the balun 64, and the matching circuit 65 provide a well-matched transmission line so that energy losses between the top-loaded dipole antenna 42 and the diplexer 66 are minimized. In an important feature, the balun 64 follows the tuning coil chains 55 and 58 rather than preceding them so that it can effectively process resistive impedances rather than complex impedances. It has been found that interchanging these elements substantially degrades antenna tuning performance and gain.

For operation in the second frequency band (108-174 MHz) of FIG. 3B, the processor 82 turns on the switching diodes 72 and an appropriate one of the switching diodes 75 to connect the balun 73 and the impedance matching circuit 74 to the diplexer 66. And for operation in the third frequency band (225-600 MHz) of FIG. 3B, the processor 82 turns on an appropriate one of the switching diodes 75 to connect the balun 76 and the impedance matching circuit 77 to the diplexer 66.

In FIG. 3A, the first, second and third impedance matching circuits 65, 74 and 77, the second and third baluns 73 and 76, and the diplexer 66 have been shown as functional blocks. In an antenna system embodiment, the elements of these circuits may be carried on different sides of the printed circuit board 59 and properly arranged (e.g., with short circuit lines) for operation at the high frequencies of the signal bands of FIG. 3B.

Figure 5A:
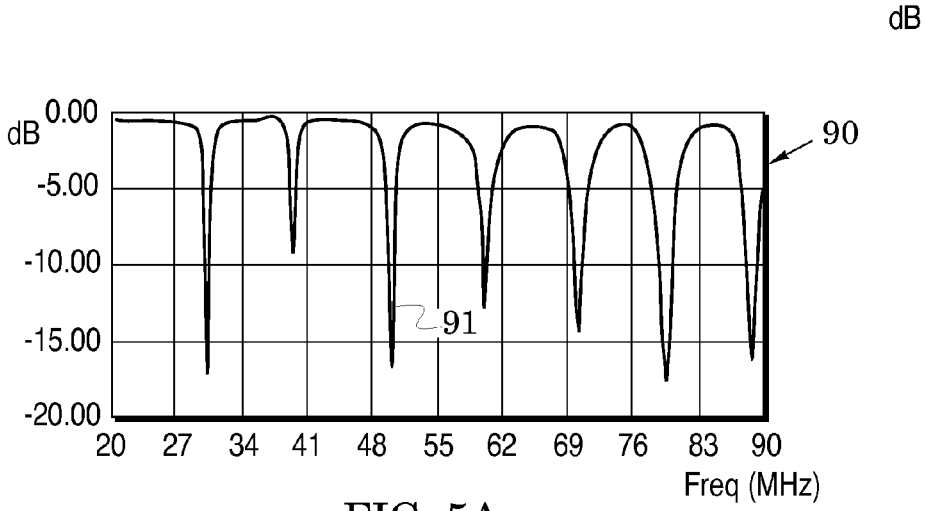
FIGS. 5A and 5B are diagrams of measured return loss in a prototype of the antenna system of FIG. 3A.
Figure 5B:
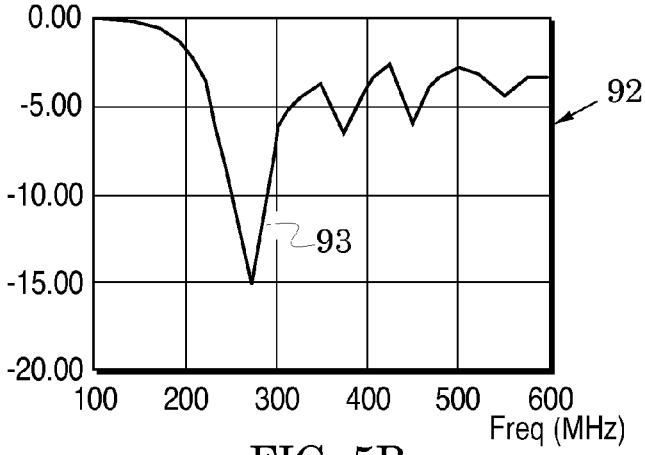

The measured performance of the antenna system 40 is indicated by the graph 90 of FIG. 5A that shows a plot 91 of return loss which is the ratio of the power reflected back to the top-loaded dipole antenna 42 to the power inserted into the tuning coil chains 55 and 58 from the antenna. The greater the return loss, the greater the power that is successfully delivered at the diplexer 66 (equivalently, the greater the power successfully provided to the top-loaded dipole antenna 42 by the transceiver 80 of FIG. 4.

The plot 91 of FIG. 5A indicates return losses at the output of diplexer 66 of seven discrete frequencies in the first frequency band of 30-88 MHz (specifically 30, 40, 50, 60, 70, 80 and 88 MHz) when the radio 70 of FIG. 4 commands these frequencies one by one. The return loss is shown in the plot 91 to exceed 9 dB at all of the seven frequencies so that the radiated power at these frequencies is more than 85% of the power applied to the antenna. The narrowness of the responses in FIG. 5A is an indication that the top-loaded dipole antenna (42 in FIG. 3A) provides high selectivity in reception mode. When reception is commanded at each of the seven frequencies, it is thus assured that nearby noise and interference will be substantially rejected. The signal-to-noise ratio performance of the radio 70 of FIG. 4 is thus seen to be excellent.

As shown by the plot 92 of graph 91 of FIG. 5B, it has also been found that the elliptical dipole antenna 50 of FIG. 3A, with its sets 51 and 53 of elliptical rings 52, is especially suited for reception and transmission of energy over wide frequency bands. In this particular embodiment, the ratio, for each ring, of the vertical to horizontal dimensions is substantially 1.4:1. The selection of ten rings was made to optimize return loss across the 225-600 MHz band. As shown by the peaks of FIG. 5B, the return loss generally exceeds 5 dB. It is noted that the matching circuit 77 of FIGS. 3A and 4 improves this to approximately 9 dB. In general, it has been found that the more elliptical rings 51 that are nested in each of the dipoles 52 and 53, the greater the number of channels at which effective power transmission is realized.

Antenna gain relates the power intensity of an antenna in a given direction to the intensity that would be produced by a hypothetical ideal antenna that radiates equally in all directions (i.e., isotropically) and that has no losses. The plot 97 of the graph 96 of FIG. 5A was measured on an antenna prototype at 39 MHz and the plot 99 of the graph 98 was measured at 75 MHz. Dots on the plot 97 indicate gains of −3 dB and −4 dB and dots on the plot 99 indicate gains of +0.5 dB and +1 dB.

Figure 6A:
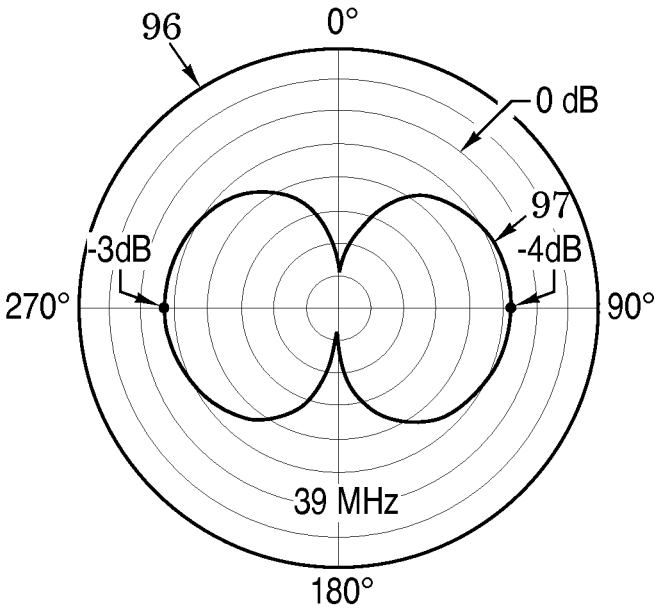
FIGS. 6A and 6B are measured gain patterns in a prototype of the antenna system of FIG. 3A.
Figure 6B:
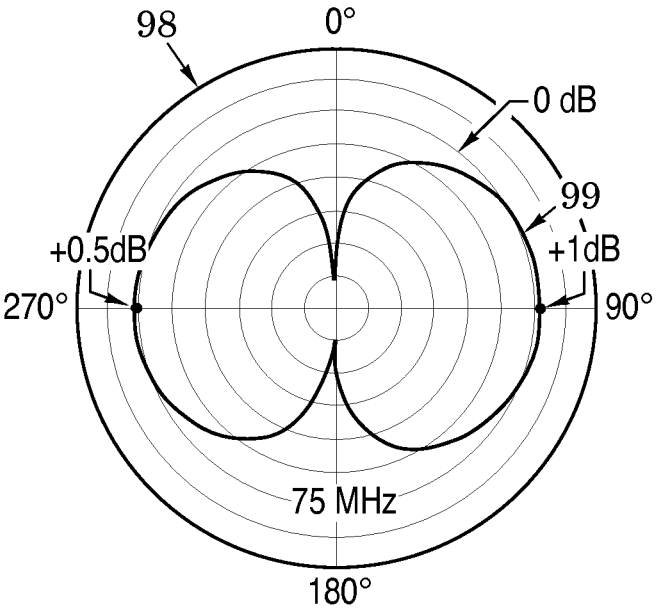

For the antenna prototype that exhibited the measured return loss of FIGS. 5A and 5B and the gain of FIGS. 6A and 6B, the physical size of the winglet antenna 20 is shown in FIG. 2A in terms of wavelength $\lambda$ at 30 MHz. As shown, the overall dimensions are a height and a width of $\lambda/20$. As also shown, the parallel portions at the top and bottom of the antenna have a width of $\lambda/44$. The height of the winglet antenna 20 must be sufficiently restricted to insure clearance from the ground when the airplane 22 of FIG. 1 is landing and taking off and when it is parked. The height of the antenna must also be sufficiently limited to insure the airplane's aerodynamic performance is not degraded. In general, the selected height is then a compromise between these physical restraints and antenna gain.

Antenna structure, operation and performance has been generally described above in terms of received signals. Because antenna performance is reciprocal, however, the descriptions are also applicable to transmitted signals.

The embodiments of the invention described herein are exemplary and numerous modifications, variations and rearrangements can be readily envisioned to achieve substantially equivalent results, all of which are intended to be embraced within the spirit and scope of the appended claims.

We claim:

1. An antenna system, comprising:

a planar, top-loaded dipole antenna to provide signals to a system output port, wherein said top-loaded dipole antenna comprises first and second top-loaded blades; and first and second strings of inductors coupled to respective blades, said system arranged such that the inductors in each string can be selectively connected in series to tune said top-loaded dipole antenna to a selected tuning frequency.

2. The system of claim 1, further including:

a planar elliptical dipole antenna arranged substantially coplanar with said top-loaded dipole antenna to provide signals to said system output port.

3. The system of claim 2, wherein said elliptical dipole antenna comprises:

a first set of nested elliptical rings; and a second set of nested elliptical rings arranged in a dipole relationship with said first set.

4. The system of claim 3, wherein centers of elliptical rings in each of said first and second sets are progressively spaced towards the other of said first and second sets.

5. The system of claim 1, further including diodes arranged across each of said inductors to enable selection thereof.

6. The system of claim 5, wherein said diodes are switching diodes, opposed pairs of which are connected in parallel with respective inductors, such that each inductor can be selectively connected in series with one of said first or second strings of inductors in response to a signal applied to the junction between the opposed pair of diodes connected in parallel with said inductor.

7. The system of claim 5, wherein said diodes are PIN diodes.

8. The system of claim 1, wherein said further including:

a balun with said first and second strings respectively coupled between said first and second top-loaded blades and said balun; and an impedance-matching circuit coupled to said balun.

9. The system of claim 1, further including:

a second balun;

first and second diodes each arranged to selectively couple a respective one of said first and second blades to said second balun; and a second impedance-matching circuit coupled to said second balun.

10. The system of claim 9, further including:

a planar elliptical dipole antenna arranged substantially coplanar with said top-loaded dipole antenna to provide signals to said output port;

a third impedance-matching circuit;

a third balun coupling said third impedance-matching circuit to said elliptical dipole antenna; and a diplexer coupled to said second and third impedance-matching circuits.

11. The system of claim 1, wherein said top-loaded dipole antenna is arranged to operate over a frequency band of 30-88 MHz.

12. The system of claim 1, wherein each of said first and second strings of inductors comprises:

a smallest inductor having an inductance L;

a second inductor having an inductance 2L;

a third inductor having an inductance 4L;

and so on, with the inductance of each subsequent inductor increasing in accordance with a binary progression.

13. The system of claim 1, wherein said system is arranged to selectively connect said inductors in series such that the combined inductances in each string substantially cancel the capacitance of the blade to which each string is connected at said selected tuning frequency.

14. The system of claim 1, wherein said inductors in each string are selectively connected in series in response to respective control signals, further including:

a processor arranged to receive a frequency word which represents said selected tuning frequency; and a digital lookup table arranged to receive a frequency code from said processor and to provide an output from which said control signals are derived such that said top-loaded dipole antenna is tuned to said selected tuning frequency.

15. An antenna system, comprising:

a planar, top-loaded dipole antenna to provide signals to a system output port; and a planar elliptical dipole antenna arranged substantially coplanar with said top-loaded dipole antenna to provide signals to said output port; wherein:

said top-loaded dipole antenna comprises a first blade terminating in an elongate first top load and a second blade terminating in an elongate second top load; and said elliptical dipole antenna is positioned between said first and second top loads.

16. The system of claim 1, further including:

a planar elliptical dipole antenna arranged substantially coplanar with said top-loaded dipole antenna to provide signals to said system output port;

a first balun, said first and second strings of inductors respectively coupled between said first and second top-loaded blades and said first balun;

a first impedance-matching circuit to couple said first balun to said system output port;

a diplexer coupled to said system output port;

a second balun;

first and second diodes each arranged to selectively couple a respective one of said first and second blades to said second balun;

a second impedance-matching circuit coupled between said second balun and said diplexer;

a third balun coupled to said elliptical dipole antenna; and a third impedance-matching circuit coupled between said third balun and said diplexer.

17. An antenna, comprising:

a first set of nested elliptical rings; and a second set of nested elliptical rings arranged in a dipole relationship with said first set, wherein the centers of the elliptical rings in each of said first and second sets are progressively spaced towards the other of said first and second sets.

18. The antenna of claim 17, wherein said rings are substantially coplanar.

19. An antenna system to be coupled to an aircraft wingtip, comprising:

a planar, top-loaded dipole antenna to provide signals to a system output port, wherein said top-loaded dipole antenna comprises first and second top-loaded blades;

a planar elliptical dipole antenna arranged substantially coplanar with said top-loaded dipole antenna to provide signals to said output port;

a planar dielectric radome aerodynamically shaped to closely surround said top-loaded dipole antenna and said elliptical dipole antenna and configured to couple to said wingtip; and first and second strings of inductors coupled to respective blades, said system arranged such that the inductors in each string can be selectively connected in series to tune said top-loaded dipole antenna to a selected tuning frequency.

20. The system of claim 19, wherein said radome is configured to mount substantially orthogonal to said wingtip.

21. The system of claim 19, wherein said elliptical dipole antenna comprises:

a first set of nested elliptical rings; and a second set of nested elliptical rings arranged in a dipole relationship with said first set.

22. The system of claim 19, further including:

a balun with said first and second strings respectively coupled between said first and second top-loaded blades and said balun; and an impedance-matching circuit coupled to said balun.

23. The system of claim 22, further including:

a second balun;

first and second diodes each arranged to selectively couple a respective one of said first and second blades to said second balun; and a second impedance-matching circuit coupled to said second balun.

24. The system of claim 22, further including:

a third impedance-matching circuit;

a third balun coupling said third impedance-matching circuit to said elliptical dipole antenna; and a diplexer coupled to said second and third impedance-matching circuits.

25. An antenna system to be coupled to an aircraft wingtip, comprising:

a planar, top-loaded dipole antenna to provide signals to a system output port;

a planar elliptical dipole antenna arranged substantially coplanar with said top-loaded dipole antenna to provide signals to said output port; and a planar dielectric radome aerodynamically shaped to closely surround said top-loaded dipole antenna and said elliptical dipole antenna and configured to couple to said wingtip; wherein:

said top-loaded dipole antenna comprises a first blade terminating in an elongate first top load and a second blade terminating in an elongate second top load; and said elliptical dipole antenna is positioned between said first and second top loads.

* * * * *